US005634889A

United States Patent [19]

Gardner et al.

[11] Patent Number: 5,634,889

[45] Date of Patent: Jun. 3, 1997

[54] MEDICAL APPLIANCE FOR INTERMITTENTLY PULSED COMPRESSION OF PROXIMAL JOINTS AND ADJACENT TISSUE OF THE HUMAN BODY

[75] Inventors: Arthur M. N. Gardner, Devon; Roger H. Fox, South Devon, both of United Kingdom

[73] Assignee: Novamedix Limited, Andover, England

[21] Appl. No.: 157,369

[22] Filed: Nov. 23, 1993

[30] Foreign Application Priority Data

Jan. 18, 1993 [GB] United Kingdom ..... 9300847

[51] Int. Cl.[6] ..... A61H 7/00

[52] U.S. Cl. ..... 601/151; 601/148

[58] Field of Search ..... 128/DIG. 20; 601/148–152; 602/26

[56] References Cited

U.S. PATENT DOCUMENTS

| | | | |
|---|---|---|---|
| Re. 32,939 | 6/1989 | Gardner et al. . | |
| Re. 32,940 | 6/1989 | Gardner et al. . | |
| 2,618,269 | 11/1952 | Baum et al. | 128/DIG. 20 |
| 3,083,708 | 4/1963 | Gottfried | 601/151 |
| 3,279,459 | 10/1966 | Schenker | 128/DIG. 20 |
| 3,403,673 | 10/1968 | MacLeod . | |
| 3,811,434 | 5/1974 | Jacobson et al. | 128/DIG. 20 |
| 3,859,989 | 1/1975 | Spielberg . | |
| 4,033,337 | 7/1977 | Raczkowski | 128/DIG. 20 |
| 4,146,021 | 3/1979 | Brosseau et al. | 602/62 |
| 4,219,892 | 9/1980 | Rigdon | 128/DIG. 20 |
| 4,378,009 | 3/1983 | Rowley et al. | 128/DIG. 20 |
| 4,408,599 | 10/1983 | Mummert | 601/152 |
| 4,509,750 | 4/1985 | Last | 128/DIG. 20 |
| 4,614,180 | 9/1986 | Gardner et al. . | |
| 4,702,232 | 10/1987 | Gardner et al. | 601/152 |
| 4,721,101 | 1/1988 | Gardner et al. . | |
| 4,832,031 | 5/1989 | Last | 128/DIG. 20 |
| 4,938,207 | 7/1990 | Vargo | 128/DIG. 20 |
| 5,022,387 | 6/1991 | Hasty | 601/152 |
| 5,310,400 | 5/1994 | Rogers et al. | 128/DIG. 20 |
| 5,334,135 | 8/1994 | Grim et al. | 602/26 |
| 5,354,260 | 10/1994 | Cook | 601/149 X |

OTHER PUBLICATIONS

Gaskell/Parrott, "The Effect of a Mechanical Venous Pump on the Circulation of the Feet in the Presence of Arterial Obstruction," Surgery, Gynecology & Obstetrics, Apr. 1978, vol. 146, pp. 583 to 592.

Gardner/Fox, "The venous footpump: influence on tissue perfusion and prevention of venous thrombosis," *Annals of the Rheumatic Diseases,* vol. 51, 1992, pp. 1173–1178.

Stranks/MacKenzie/Grover/Fail, "The A–V Impulse System Reduces Deep–Vein Thrombosis and Swelling After Hemi-arthroplasty for Hip Fracture," Journal of Bone Joint Surgery (British), vol. 74–B, No. 5, Sep. 1992, pp. 775–778.

Gardner, "Inferior vena caval interruption in the prevention of fatal pulmonary embolism," *American Heart Journal,* vol. 95, No. 6, Jun. 1978, pp. 679–682.

The Aire–Fit Pad and Brace Co., Elyria, Ohio, The Oalma Journal, Aire–Fit Braces, May 1951, p. 30.

*Primary Examiner*—Robert A. Hafer
*Assistant Examiner*—Brian E. Hanlon
*Attorney, Agent, or Firm*—Hopgood, Calimafde, Kalil & Judlowe

[57] ABSTRACT

A medical appliance for intermittent compressive excitation of body tissue in the region of a proximal joint provides relief of pain and/or swelling at or near the joint. Specifically, a sleeve or wrap of the involved joint, wherein the sleeve or wrap has certain directionally oriented features of relative flexibility, retains an inflatable bag near the joint, and a relatively non-stretch circumferential tie surrounds the sleeve and is, at least in part, in register with the retained flexible bag. Apparatus is provided for rapid transient inflation of the bag, followed by relaxation for a predetermined period of time prior to initiation of the next such pulsed inflation. Various forms of sleeve or wrap are described, as are also various forms of inflatable bag.

17 Claims, 4 Drawing Sheets

MEDICAL APPLIANCE FOR INTERMITTENTLY PULSED COMPRESSION OF PROXIMAL JOINTS AND ADJACENT TISSUE OF THE HUMAN BODY

BACKGROUND OF THE INVENTION

The invention relates to medical devices for intermittently pulsed compression of a part of the human body, specifically for intermittent compression at or near a joint, such as a knee, an elbow or a shoulder, in treatment of a painful disorder of tissue circulation at or near the joint.

It is known from U.S. Pat. No. 4,614,180 that impulse compression, locally applied as intermittent pressure pulses in the plantar region of the foot, is an effective means of enhancing venous-return of blood to the heart. This technique is an artificial substitute for the action of weight-bearing, in alternation between one foot and the other, in the course of walking, for a healthy person, by reason of body weight flattening the plantar arch, i.e., transiently spreading the ball and heel of the foot slightly apart, with concomitant stretching and necking-down of the veins in the plantar region. For the patient who is unable to walk and who may have a thrombotic condition with accompanying pain, the artificially induced intermittent compression of the plantar region has been found to provide the patient with a highly effective means of assuring venous return, of such therapeutic value as to bring welcome relief from pain, as well as to reduce swelling and, in many cases, to eliminate the thrombotic condition. U.S. Pat. No. 4,721,101 describes an extension of the same concept, with slight modification, indicating that such action on the plantar veins can also be effective in enhancement of arterial flow in the involved limb.

Impulse compression devices of the character indicated rely on the facts (i) that veins of the plantar complex provide a reservoir of accumulated and accumulating blood, and (ii) that the venous system is characterized by check valves to assure against back flow of blood that must be returned to the heart in the course of healthy circulation. The reservoir veins are squeezed to force blood return via the one-way return system of check valves, for each compressional action on the plantar veins. A suitable inactive period of about 20 seconds allows the plantar veins to swell with a new charge of blood, to be returned by the next compressive actuation at the plantar region.

BRIEF STATEMENT OF THE INVENTION

The present invention is by the same inventors and derives from their discovery that impulse compression, of much the same nature as delivered to blood-laden plantar veins, also has therapeutic value of different kind in application to proximal joints, in treatment of painful disorders of tissue circulation at or near the joint. So-called "tennis elbow" is merely an example of such a disorder, for there are many and various causes of pain at commonly afflicted proximal joints, such as the elbow, the knee (e.g., "knee effusions") and the shoulder (e.g., so-called "frozen shoulder"). Plainly, the action is not one of intermittently pulsed compression of a reservoir of accumulating blood; an adequate theory has yet to fully explain the precise mechanics of pulsed compression at or near such proximal joints, but the pressure pulses, at intervals of at least 15 seconds between pulses, are known to be effective in reduction of pain and swelling. Currently, the mode of action is believed to be one of locally increasing the blood supply in capillaries of compressively activated tissue, where veins accompany arteries on a microscale, an arrangement that would enable feedback by convective transport of EDRF[1], consistent with the reported findings of Ley, Tigno, Pries and Geahtgens in their paper, "Blood Flow Regulation in Microvascular Networks: Role Of Venulo-arterial Communication", Int. J. Microcirc, Vol. 8:Suppl 1:46 (1989).

[1] Endothelial Derived Relaxing Factor, with accompanying local release of nitric oxide, having a half-life of about 9 seconds.

It is an object of the invention to provide a medical appliance for intermittent compressive excitation of body tissue in the region of a proximal joint, in relief of pain and/or swelling at or near the joint.

Another object is to achieve the above object with relatively simple apparatus, usable by relatively unskilled personnel, and in part using an available source of impulsing energy and action.

It is also an object to enable a physician or medical technician to achieve the foregoing objects by providing a kit of one or more separate components, some of which are sized particularly for application to or near certain parts of an injured or painful limb, to enable use of the kit in service of different physical situations and with greatest latitude for the physician's judgement in use.

The invention achieves the foregoing objects by providing a sleeve or wrap of an involved joint, including distal and proximal limb structure adjacent the joint, wherein the sleeve has certain features of relative flexibility and retains an inflatable bag near the joint. A relatively non-stretch circumferential tie surrounds the sleeve and is, at least in part, in register with the retained flexible bag. Apparatus is provided for rapid transient inflation of the bag, followed by relaxation for a period of at least 15 seconds prior to initiation of the next such pulsed inflation. Various forms of sleeve or wrap are described, as are also various forms of inflatable bag.

BRIEF DESCRIPTION OF THE DRAWINGS

The invention will be described in detail in conjunction with the accompanying drawings, which show, for illustrative purposes only, various embodiments of the invention. In said drawings.

DETAILED DESCRIPTION

Figure 1:
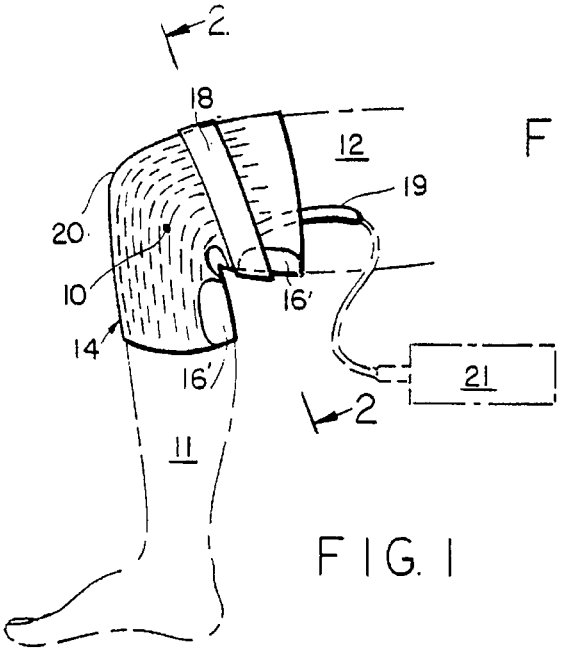
FIG. 1 is a simplified view in side elevation, showing a leg, to the knee region of which an impulse-compression device of the invention has been applied.
Figure 2:
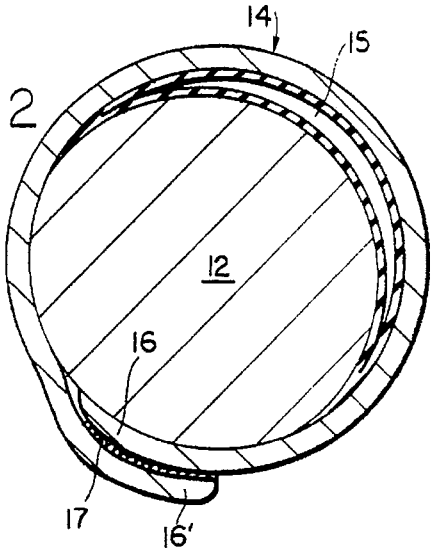
FIG. 2 is an enlarged and simplified cross-section taken at 2—2 in FIG. 1, for preferred embodiment.
Figure 2A:
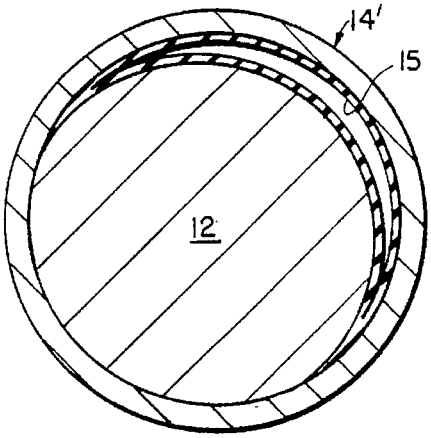
FIG. 2A is a view similar to FIG. 2 for another embodiment.

In FIG. 1, the invention is shown in application to a knee joint, for which a heavy dot 10 will be understood to indicate the axis of flexion and extension between the distal limb or calf 11 and the proximal limb or thigh 12. A sleeve 14 is shown circumferentially enveloping not only the joint per se but also adjacent regions of both the distal limb 11 and the proximal limb 12. An inflatable bag 15 (see FIG. 2) is held by sleeve 14 in wrapped conformance to the adjacent limb (12). In FIG. 2, sleeve 14 is shown in its preferred form as a circumferential wrap from initially flat material, with overlapping ends 16, 16' which are adjustably and detachably secured at 17, as by engaging surfaces of hook material and loop material; in the alternative of FIG. 2A, sleeve 14' is circumferentially continuous and sufficiently stretchable for manipulated placement over the knee as shown. The inflatable bag extends for an angularly limited range of the circumference of the limb, and as shown in FIG. 1, a belt or strap 18 wraps the sleeve, to complete a circumferential tie at a location in overlapping registration with the inflatable bag; thus, in FIG. 1, only a flexible tubular member 19, for supply of pulsed inlet inflation air, is exposed from beneath the adjacent proximal end of sleeve 14.

In applying the sleeve 14 and its retained inflatable bag to the knee region of FIG. 1, it is generally recommended that a soft cloth or stockinette layer (not shown) be first applied, to permit a measure of ventilation of skin surfaces and to prevent local chafing from pulsed inflation of bag. The bag 15 may comprise two like panels of flexible plastic material, peripherally welded to each other, and including the flexible inlet member 19; a preference is indicated that at least one of the bag panels shall be puncturable, so that the punctured panel can be a source of cooling air flow, for greater comfort of the patient. In the event of a stockinette wrap, it is convenient first to locate the bag where desired on the stockinette, as by use of double-stick tape, and then to apply sleeve 14 and the circumferential tie 18, in the indicated lapping register. In particular, it is recommended that bag 15 and tie 18 be at offset from the bony prominence or patella (knee cap) 20 of the joint, yet otherwise in proximity to the region of axis 10.

To serve the purposes of patient comfort in the course of using the invention, the sleeve 14 (or 14') is specially characterized for relative stretchability in the circumferential direction and for relative unstretchability in the longitudinal direction of the limbs 11, 12 to which the sleeve is applied. This relation of directional elastic properties accords with teachings of FIGS. 2 and 4 of pending U.S. patent application Ser. No. 07/952,344, filed Sep. 28, 1992 (now U.S. Pat. No. 5,267,952). The particular structure to achieve such a relationship in sleeve 14 will be described in connection with FIGS. 3, 4 and 5; it suffices at this point to identify in FIG. 1 circumferentially spaced rows of longitudinally extending slits, wherein the slits of adjacent rows are in longitudinally staggered relation.

In use of the invention, when the appliance of FIG. 2 has been secured as described, a pump apparatus 21 connected to inlet 19 is operated to supply bag-inflating pulses of compressed air, at intervals of at least 15 seconds. Each inflation is rapidly delivered, in one second or less, and to a peak pressure of at least 75-mm Hg, to thereby cause bag 15 to react within the confines of the circumferential tie 18, for delivery of a concomitant pressure pulse to microcirculatory structure of tissue adjacent the knee joint. The commercially available pump apparatus supplied by Novamedix, Ltd. of Andover, Hampshire, England, for operation of their so-called AVI foot-pump system is well suited to present purposes at 21 and therefore need not be described in detail. It suffices here to state that a range of bag-inflation peak pressures is selectively available up to pressures in excess of 200-mm Hg, that the rise to peak pressure can be and is preferably rapidly deliverable in 0.5 second or less, and that the interval between successive pulses is selectively available over a range up to 60 seconds, with 20 seconds being preferred. Further, the commercial Novamedix pumping apparatus provides for selective control of a period up to six seconds during which peak or substantially peak pressure can be retained, prior to rapid deflation of bag 15. Limits of the indicated available ranges of pulsed inflation of bag 14 have not as yet been ascertained but present preferences have in general been stated.

Figure 3:
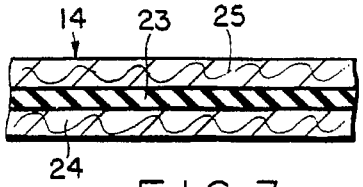
FIG. 3 is a greatly enlarged, fragmentary sectional view of sleeve or wrap material used in the invention.
Figure 4:
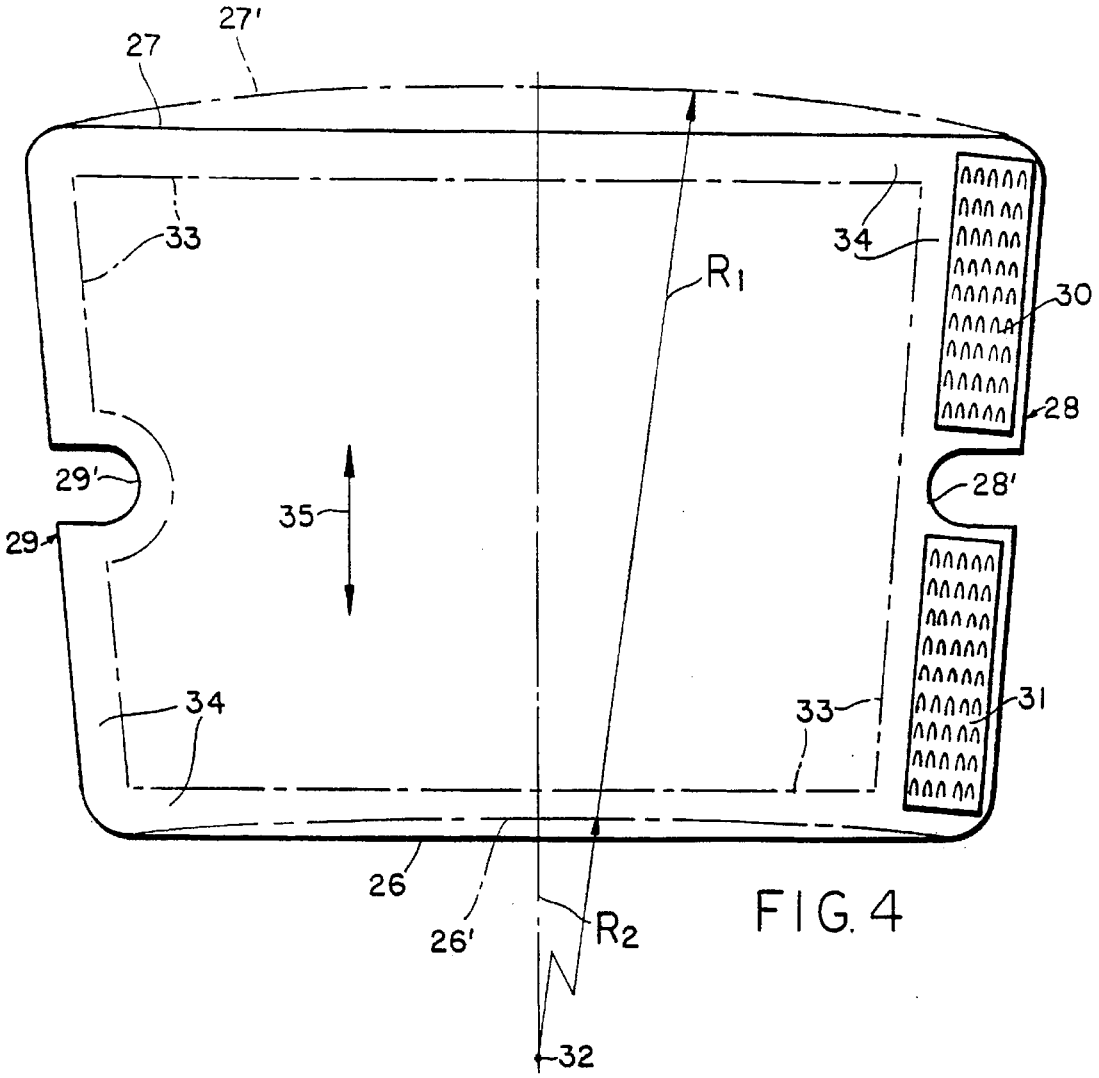
FIG. 4 is a flattened plan view of sleeve-wrap material of FIG. 2.
Figure 5:
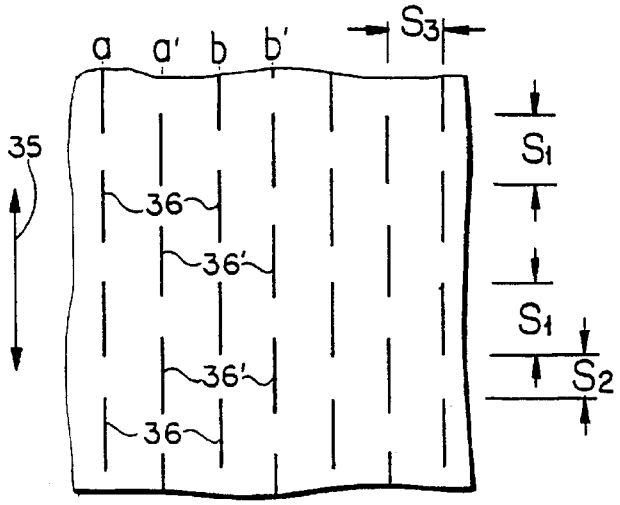
FIG. 5 is an enlarged fragmentary detail of the plan view of FIG. 4.

Directing attention to FIGS. 3, 4 and 5, the construction of sleeve 14 (14') is seen to comprise laminations to a central sheet 23 of flexible elastomeric material, wherein an inner lamination 24 of woven fabric is of smooth and soft finish, for patient comfort, and an outer lamination 25 is of such relatively coarse weave as to be to a degree engageable by commercially available hook material, as for example that material known under the mark VELCRO. The material of sleeve 14 is thus a flexible laminated sandwich, having a profile in flattened condition as shown in FIG. 4. This profile may be described as generally rectangular, or more accurately as generally trapezoidal, wherein a distal edge or margin 26 is of shorter extent $D_1$ than a proximal edge or margin 27 of greater extent $D_2$. The longitudinal dimension of an installed sleeve 14 is accounted for as the space between the distal and proximal edges 26, 27, and the flattened profile of the material of sleeve 14 is characterized by opposite lateral edges 28, 29 which converge in the distal direction. These lateral edges are designed for the lapped engagement described in connection with FIG. 2, and each of these lateral edges is centrally recessed at 28', 29', so that there can be separate circumferential completion of sleeve 14 around the proximal region of adjacency to the knee, independent of a separate circumferential completion of sleeve 14 around the distal region of adjacency to the knee. The recesses 28', 29' are of sufficient width and depth to enable relatively comfortable flexing of the knee, when the recessed regions between distal and proximal laps 28, 29 of sleeve 14 are located on the concave side of limb flexure at the knee, as shown in FIG. 1. To enable the circumferentially completing laps to be self retaining, separate pads 30, 31 of the indicated hook material are shown along the inner-surface portions of edge 28, for lap-retaining engagement with the coarsely woven fabric of outer surface lamination 25 of the composite sleeve material. Alternatively, the outer-surface portions of edge 29 may be provided with suitably stitched pads (not shown) of loop material compatible with the hook material of pads 30, 31.

Consistent with the "generally rectangular" and "generally trapezoidal" expressions thus far used in describing the profile of sleeve (14) material, a preference is indicated that, for cosmetic appearance, the proximal edge 27 shall be a convex arc and the distal edge 26 shall be a concave arc, and that both arcs shall be about the same distally remote center 32 and at the respective radii $R_1$, $R_2$ indicated in FIG. 4 by arcs described with phantom outlines 26', 27' str0ictly speaking, with such inner and outer arcs, the profile is that of a sector, i.e., an angular portion of a circle between two radii about the same center.

To complete a description of sleeve 14, further reference is made to FIG. 5 wherein the above-noted longitudinally slitted nature of sleeve 14 is shown in illustrative and enlarged detail, a preference being indicated that such slitting be confined within borders delineated by heavy phantom outlines 33 in FIG. 4, so as to establish a peripherally continuous margin 34 outside the outline 33. For convenience, a symbolism is adopted with a double-headed arrow 35 in FIGS. 4 and 5 to display the directional orientation of all slits in sleeve 14; this direction will sometimes be referred to as longitudinal, consistent with the elongate direction of ultimately installed limb directions; the orthogonally related direction is the direction of relative stretchability, sometimes referred to as the lateral, or circumferential direction.

In FIG. 5, slits 36 in odd-numbered row alignments a, b, are equal in length $S_1$ to slits 36' in even-numbered rows a', b', and the respective longitudinal spacing $S_2$ between all slits 36 in the odd-numbered rows is the same as the spacing between all slits 36' of the odd-numbered rows. Suitably, slit length $S_1$ may be 10-mm, and slit spacing $S_2$ may be in the range 5 to 8-mm, to allow for at least a 1-mm overlap of both ends of slits of one row, with respect to slits of the next-adjacent row, for the symmetrically staggered interlace relation shown. For the preferred slit dimensions and relations stated, a spacing $S_3$ of 3 to 6-mm between adjacent rows is satisfactory, with a preference stated for an $S_3$ dimension of 4 to 5-mm. All slits 36 may be knife cuts or narrow punchings through all laminations of the material of sleeve 14.

Figure 6:
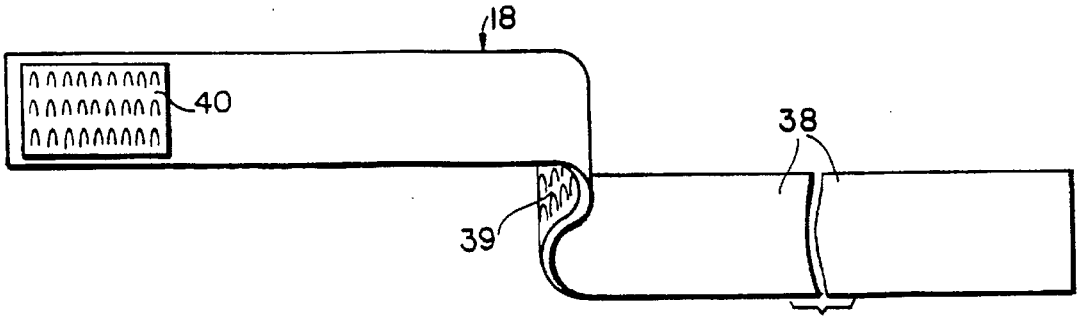
FIG. 6 is a view of a circumferential-tie component of FIG. 1.

In the diagram of FIG. 6, it is indicated that the circumferential tie 18 may be a single elongate strip 38 of hook material wherein the hook material finish is on the underside 39, for circumferential engageability with the coarsely woven outer ply of sleeve 14, while the outer surface is relatively smooth, all except for a patch 40 of loop material, preferably locally stitched or otherwise secured to the smooth outer surface.

Figure 7A:
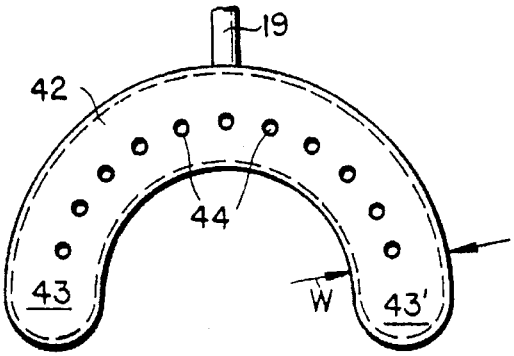
FIGS. 7A, 7B, 7C and 7D are plan views of alternative inflatable bags for optional use in the device of FIG. 1.

FIGS. 7A to 7D illustrate various forms of inflatable pad, to different contours, offering the physician a range of options to suit what he deems to be a particular patient's requirement. In all cases, these different pads comprise two panels of flexible plastic material, to the same peripheral contour and edge-welded, as suggested by dashed-line markings adjacent the peripheral contour of the pad. Also, in all cases a flexible inlet tube 19 provides sealed communication of pressure pulses to the interior of the bag. In FIG. 7A, the bag 42 has an arcuate configuration generally conforming to a horseshoe shape, wherein the width W may be in the range 40 to 60-mm, and the arcuate extent may be sufficient to wrap around the outer profile of the limb, in encircling but spaced relation to the bony prominence 20, and with the end regions 43, 43' of bag 42 either in register with or near-register with opposite ends of the axis 10 of knee articulation; such an arrangement enables delivery of simultaneous and oppositely directed pulsed compression of the joint on or close to tissues near axis 10. And more concentrated delivery of such localized pressure pulses may be enhanced by distributing a plurality of spaced spot welds 44 of the involved panels to each other, to points short of the arcuate limits of the bag 42. As with all inflatable bags (and sleeves 14, 14'), actual dimensions will be a function of the physical dimensions of the involved patient and limbs connected at the involved point.

Figure 7C:
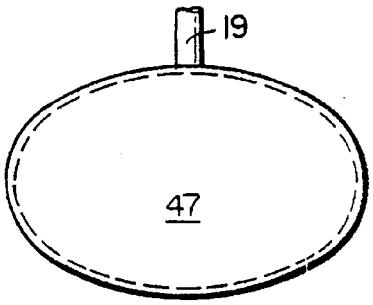
Figure 7B:
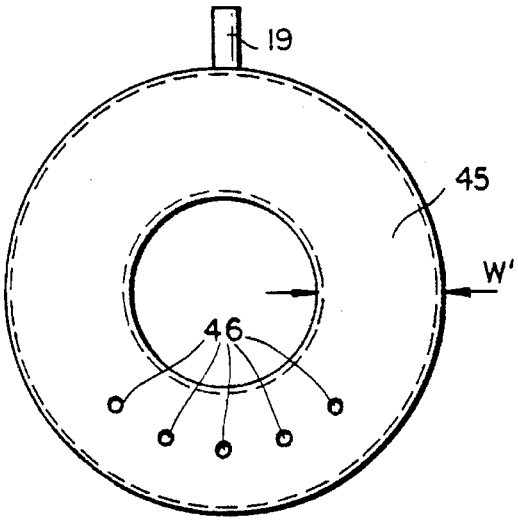

The inflatable bag 45 of FIG. 7B is of annular configuration wherein radial width W' may be 50-mm. In this case, something approximating the horseshoe, or preferentially arcuate pattern of delivered impact pulses, is achievable by providing a succession of local spot welds 46 of the bag panels to each other.

The inflatable bag 47 of FIG. 7C is of generally elliptical configuration to enable an entire inflatable bag to be totally lapped by a single circumferential tie 18, where the width of the tie 18 equals or exceeds the minor-axis dimension of the ellipse.

Figure 7D:
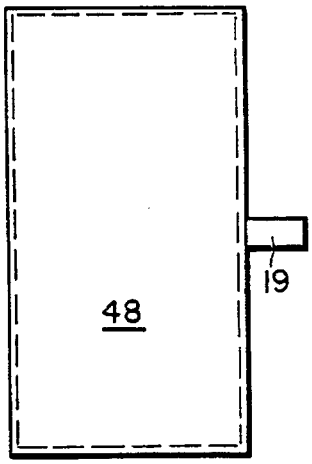

The inflatable bag 48 of FIG. 7D is of elongate rectangular proportions, as for a purpose similar to that expressed for the configuration of FIG. 7C, except that of course the configuration of FIG. 7D will permit a more uniform application of pulsed compressional pressure values, throughout the applicable circumferential extent of the bag.

Figure 1A:
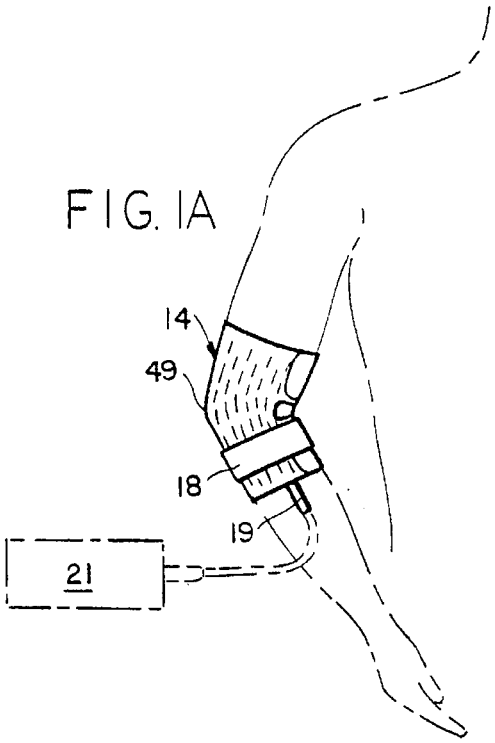
FIG. 1A is a view similar to FIG. 1, showing an appliance of the invention fitted for treatment of a tennis-elbow or the like condition.

FIG. 1A is a view similar to that of FIG. 1, but showing the invention in application to an elbow, to which a sleeve 14 has been applied, with a circumferential tie 18 applied to a distal-limb location of adjacency to but offset from the bony prominence 49 (the olecranon) of the elbow. Except for specific dimensions to accommodate the size of a particular patient's features at and near the elbow, the description of appliance components and their operation are as described for the knee-joint situation of FIG. 1.

Figure 8:
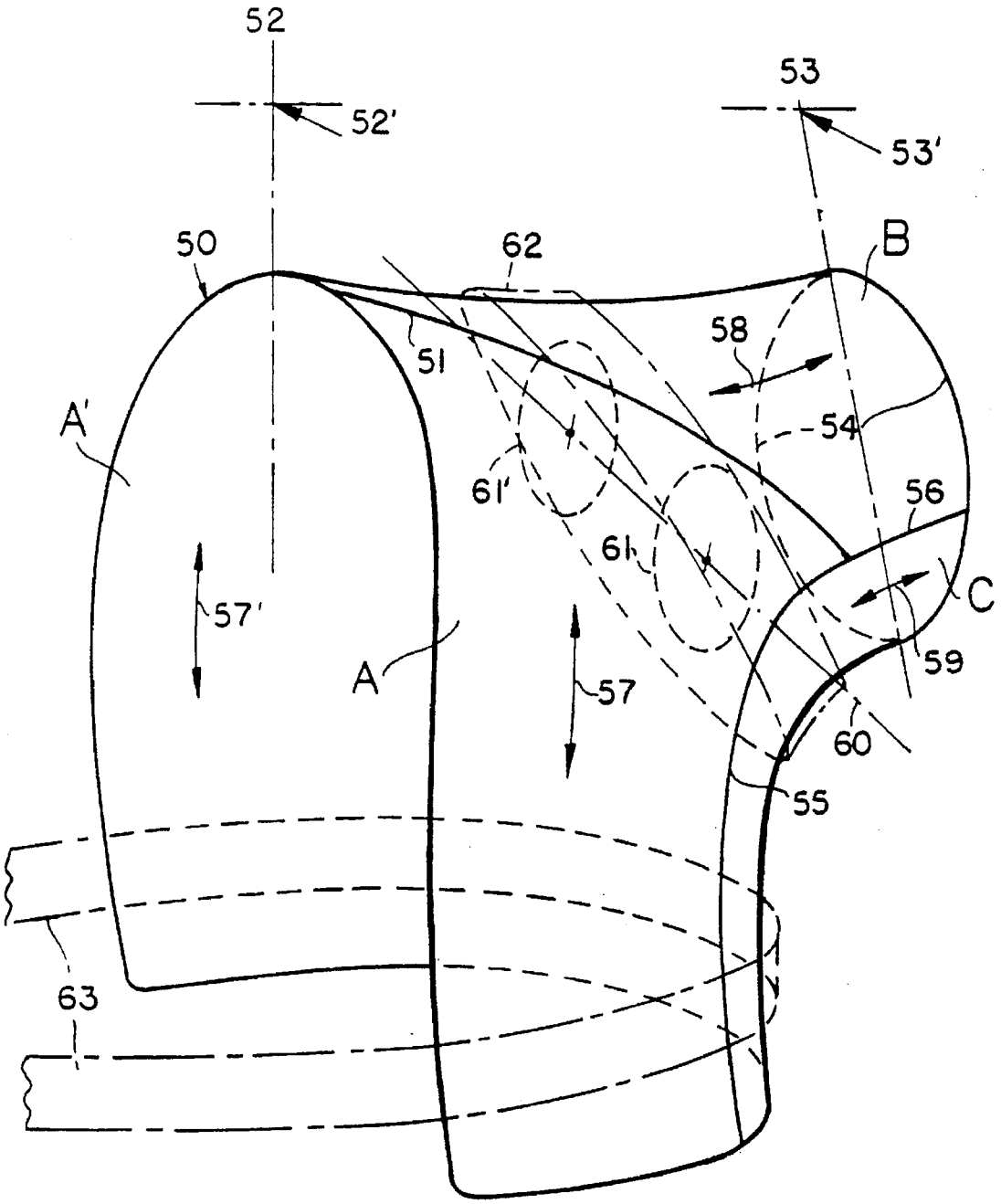
FIG. 8 is a simplified view in perspective showing a wrap of the invention with provision for impulse compression therapy for treatment of a frozen-shoulder condition.

The configuration of FIG. 8 is a wrap in the form of a half-jacket 50 of sleeve material as described in connection with FIG. 3. The jacket-like wrap 50 comprises like front and back panels A, A' of such material, connected by stitched seams, as at 51, to an upper bridging panel B, on the directly viewable side of a vertical plane of symmetry, wherein the said plane is defined by lines 52, 53 in the drawing. It will be seen that panel B is generally arcuate, extending over the top of a patient's shoulder, and that its distal end defines the upper arcuate half of the generally circular opening 54 for admission of the patient's arm; in FIG. 8, the arrows 52', 53' will be understood to be normals to the vertical plane of symmetry which contains line 52 at the body end of the article 50 and which also contains line 53 through central points at upper and lower limits of the arm-hole opening 54. Further, it will be understood that seam 51 has its image at a like seam of panels A' and B to each other, but that this image location of another seam does not appear in FIG. 8, so as not to unduly complicate the drawing. A fourth panel C of the same material of FIG. 3 is a body-side panel that is stitched along seam 55 to panel A, and panel C is similarly stitched along a corresponding seam (not shown) to the back panel A'. The body-side panel C is also stitched along seam 56 to the upper bridging panel B, as well as along a corresponding seam connection (not shown) to the other side of the upper bridging panel B. And with these two seam connections (at 56, and at the image location thereof), panel C completes the circular opening 54 for arm insertion. Double-headed arrows 57 on panel A, 57' on panel A', 58 on panel B, and 59 on panel C will be understood to express the longitudinal direction of the slit pattern described in connection with FIG. 5. Thus, around the opening for passage of the patient's arm, the primary stretchable orientation is one of circumferential continuity. And at wrap of the involved half of the patient's chest or torso, the primary stretchability is circumferential, for the extent of torso engagement.

With the jacket-like wrap 50 and on an alignment 60 of pulsed compressional excitation (available from the means 21 of FIGS. 1 and 1A), two like inflatable pads 61, 61' are adhered either to the patient or to the inner surface of wrap 50. And a suitable strap 62, as described at FIG. 6 and of width to substantially overlap both pads 61, 61', establishes a circumferential tie for the previously described alignment of simultaneous impulse compression in the region of adjacency to the shoulder joint, while also at offset from the bony prominence (the acromion) of the joint. A second circumferential tie 63, of more elastic nature as provided by a strip of elastomeric material having hook-and-loop end-attachment features (not shown) will provide assurance of retained torso envelopment via panels A, C, and A'.

Operation of the arrangement of FIG. 8 is in exact correspondence to the embodiments of FIGS. 1 and 1A. The pulsed compression is applied to microscale capillary components of the vascular and arterial systems. There is no single reservoir to receive pumping action, as at the plantar arch, but these multiple capillary components abound, in the skin areas adjacent the joint. Not only are pain and swelling caused to reduce, but there is now evidence that blood flow is enhanced in capillaries at the region of the involved joint.

What is claimed is:

1. A medical appliance for intermittently pulsed compression of a human joint in treatment of a painful disorder of tissue circulation at or near the joint, said appliance comprising:

(a) a flexible sleeve of length adapted to circumferentially envelop longitudinal limb structure that is distally adjacent the joint as well as longitudinal limb structure that is proximally adjacent the joint, said sleeve having greater resistance to stretching elongation in the longitudinal direction than resistance of said sleeve to circumferential stretch;

(b) at least one inflatable bag adapted to be retained between a portion of said sleeve and limited to adjacent tissue at and near the joint to which the sleeve is applied, said bag having a flexible pneumatic-supply tube of length to extend outside said sleeve, said bag having capacity to withstand periodically repeated pulsed inflation to a peak pressure amplitude of at least 75-mm Hg within one second or less, followed by relaxation of inflation pressure between pulses of inflation pressure;

(c) at least one length of flexible non-stretch tape that is long enough between opposite ends to complete a circumferentially secured tie of the sleeve upon securing the tape ends to each other, said circumferentially secured tie of the sleeve being also in overlap with at least a portion of said inflatable bag; and (d) cyclically operable automatic means for delivering pulses of pressure within the bag in accordance with the following criterion: a pressure rise to a peak amplitude of at least 75-mm Hg within one second or less, followed by a relaxation of pressure for a period of at least 15 seconds before a repeat of the pressure rise.

2. The medical appliance of claim 1, for intermittently pulsed compression of a joint having a bony prominence, said sleeve being of length adapted to retain said bag substantially in avoidance of overlap with the bony prominence of the joint.

3. The medical appliance of claim 2, wherein the inflatable bag is generally arcuate for adapted application in arcuate placement about the bony prominence of the joint, said inflatable bag being of such arcuate extent as to be adapted for orientation such that the arcuate ends of the bag can extend into relative proximity with the respective ends of the axis of flexion and extension of the joint, and said sleeve being adapted to fully overlap at least the ends of said bag when in said orientation.

4. The medical appliance of claim 1, wherein the retained bag within said sleeve has at least one region of limb-surface active engagement, wherein said one region substantially surrounds the axis of flexion and extension of the joint.

5. The medical appliance of claim 4, wherein the inflatable bag is one of two, and wherein the second bag is adapted for retention by said sleeve at a region of limb-surface active engagement which is opposite said one region and also surrounds the axis of flexion and extension of the joint, the second bag being adapted for meeting said criterion concurrently with said first-mentioned bag.

6. The medical appliance of claim 1, wherein said sleeve is a laminated flexible sheet of multiple plies, comprising a core ply of elastomeric material, an inner ply of woven material, and an outer ply of woven material.

7. The medical appliance of claim 6, wherein said sleeve is tubular.

8. The medical appliance of claim 6, wherein said sleeve is a circumferential wrap of laminated sheet materials of generally trapezoidal planiform, with wrapped opposite ends of the wrap in partial detachably connected overlay.

9. The medical appliance of claim 8, wherein said opposite ends are each recessed at a central longitudinal region of their detachably secured overlap, whereby the sleeve is adapted for a first circumferentially continuous wrap of the region of distal adjacency to the joint and is adapted for a second circumferentially continuous wrap of the region of proximal adjacency to the joint, said recesses being of sufficient depth to provide an intermediate region of less than full circumferential envelopment of the joint.

10. The medical appliance of claim 8, wherein said lapped ends are defined by opposing divergent ends of said generally trapezoidal planiform.

11. The medical appliance of claim 8, in which said generally trapezoidal planiform is generally the shape of a sector wherein longitudinal ends are arcs of the same angular extent about a common geometric center, and wherein lateral sides extend radially to define angular limits of said arcs.

12. The medical appliance of claim 11, wherein said radially extending lateral sides are each recessed at corresponding locations substantially midway between said arcuate ends, the depth of the recesses being for substantially the extent of detachably connected overlap, to thereby detachably establish a circumferentially complete proximal sleeve portion apart from a circumferentially complete distal sleeve portion.

13. A medical appliance for intermittently pulsed compression of a human joint in treatment of a painful disorder of tissue circulation at or near the joint, said appliance comprising:

(a) a flexible sleeve of length to circumferentially envelop limb-connecting structure that is longitudinally adjacent the joint, said sleeve having great resistance to stretching elongation in the longitudinal direction and having a resistance to circumferential stretch which is low relative to said great resistance;

(b) at least one inflatable bag adapted to be retained between a portion of said sleeve and limited to adjacent tissue at and near the joint to which the sleeve is applied, said bag having a flexible pneumatic-supply tube of length to extend outside said sleeve, said bag having capacity to withstand periodically repeated pulsed inflation to a peak pressure amplitude of at least 75-mm Hg within one second or less, followed by relaxation of inflation pressure between pulses of inflation pressure;

(c) a length of non-stretch tape that is long enough between its longitudinal ends to complete a circumferentially secured tie of the sleeve upon securing the tape ends to each other, with the circumferential tie in overlap with said bag; and (d) cyclically operable automatic means for delivering pulses of pressure within the bag in accordance with the following criterion: a pressure rise to a peak amplitude of at least 75-mm Hg within one second or less, followed by a relaxation of pressure for a period of at least 15 seconds before a repeat of the pressure rise.

14. The medical appliance of claim 13, wherein the joint has a bony prominence and said sleeve is adapted to retain said bag substantially in avoidance of overlap with the bony prominence of the joint.

15. A kit of components for intermittently pulsed compression of a human joint in treatment of a painful disorder of tissue circulation at or near the joint, said kit comprising:

(a) a flexible sleeve of length to circumferentially envelop longitudinal limb structure that is distally adjacent the joint and longitudinal limb structure that is proximally adjacent the joint, said sleeve having great resistance to stretching elongation in the longitudinal direction and having a resistance to circumferential stretch action which is low relative to said great resistance;

(b) an inflatable bag adapted to be retained between a portion of said sleeve and essentially only adjacent tissue at and near the joint to which the sleeve is applied, said bag having a flexible pneumatic-supply tube of length to extend outside the sleeve when retained by the sleeve, said tube being adapted for connection to a source of intermittently pulsed pneumatic supply to a peak pressure exceeding 75-mm Hg, and said bag having capacity to withstand periodically repeated pulsed inflation to a peak pressure amplitude of at least 75-mm Hg within one second or less, followed by relaxation of inflation pressure between pulses of inflation pressure; and (c) a length of flexible non-stretch tape that is long enough between opposite ends to complete a circumferentially secured tie of the sleeve upon securing the tape ends to each other.

16. The kit of claim 15, in which said sleeve comprises a laminated flexible sheet of multiple plies comprising a core ply of elastomeric material, an inner ply of woven material, and an outer ply of woven material; said tape having an inner surface of hook material and an outer surface of loop material, and the weave of said outer ply being of such coarse texture as to be adapted for releasably retaining engagement to the inner surface of the tape, so that the circumferential tie may involve full circumferential engagement of the tape to the sleeve, in addition to hook-and-loop fastening of the tape to itself upon completion of the circumferential tie.

17. The kit of claim 15, wherein said sleeve comprises a flat flexible, generally trapezoidal sheet which is of longitudinal extent for the enveloped length of both longitudinal limb structures, said sheet being of width between lateral edges sufficient to circumferentially envelop both said limb structures when said lateral edges are overlapped, and means at each of said edges and coacting between said edges for detachably retaining their lapped condition.

* * * * *

UNITED STATES PATENT AND TRADEMARK OFFICE

CERTIFICATE OF CORRECTION

PATENT NO. : 5,634,889

DATED : June 3, 1997

INVENTOR(S) : Arthur M. N. Gardner
Roger H. Fox

It is certified that error appears in the above-indentified patent and that said Letters Patent is hereby corrected as shown below:

Column 4, line 57; after "phantom outlines 26', 27'"
delete "str0ictly"
and insert therefor --; strictly--

Signed and Sealed this

Fourteenth Day of October, 1997

*Attest:*

*Attesting Officer*

BRUCE LEHMAN

*Commissioner of Patents and Trademarks*